US010835936B2

(12) United States Patent
Vogt

(10) Patent No.: US 10,835,936 B2
(45) Date of Patent: Nov. 17, 2020

(54) LADDER CLEANING DEVICE

(71) Applicant: BoVo ApS, Tim (DK)

(72) Inventor: Bjarne Vogt, Ringkøbing (DK)

(73) Assignee: BoVo ApS, Tim (DK)

( * ) Notice: Subject to any disclaimer, the term of this patent is extended or adjusted under 35 U.S.C. 154(b) by 176 days.

(21) Appl. No.: 15/778,241

(22) PCT Filed: Nov. 23, 2016

(86) PCT No.: PCT/DK2016/050389
§ 371 (c)(1),
(2) Date: May 23, 2018

(87) PCT Pub. No.: WO2017/088886
PCT Pub. Date: Jun. 1, 2017

(65) Prior Publication Data

US 2018/0345333 A1 Dec. 6, 2018

(30) Foreign Application Priority Data

Nov. 23, 2015 (DK) ..... 2015 70750

(51) Int. Cl.

| | |
|---|---|
| ***B08B 1/00*** | (2006.01) |
| ***B08B 7/04*** | (2006.01) |
| ***E02B 17/00*** | (2006.01) |
| ***E06C 7/00*** | (2006.01) |
| ***B08B 3/02*** | (2006.01) |
| ***B08B 3/00*** | (2006.01) |
| ***A47L 25/00*** | (2006.01) |
| ***B08B 1/04*** | (2006.01) |

(52) U.S. Cl.
CPC ..... *B08B 7/04* (2013.01); *A47L 25/00* (2013.01); *B08B 1/00* (2013.01); *B08B 1/002* (2013.01); *B08B 1/005* (2013.01); *B08B 1/04* (2013.01); *B08B 3/00* (2013.01); *B08B 3/024* (2013.01); *E02B 17/0034* (2013.01); *E06C 7/00* (2013.01); *B08B 2203/0223* (2013.01)

(58) Field of Classification Search
CPC combination set(s) only.
See application file for complete search history.

(56) References Cited

U.S. PATENT DOCUMENTS

| | | | |
|---|---|---|---|
| 1,134,881 | A | 4/1915 | Lockwood |
| 4,612,056 | A | 9/1986 | Gibson |
| 6,367,584 | B1 | 4/2002 | Edwards |
| 2009/0178216 | A1 | 7/2009 | Lawler |
| 2014/0299412 | A1 | 10/2014 | Cordani |

FOREIGN PATENT DOCUMENTS

| | | | | |
|---|---|---|---|---|
| EP | 3045652 | A1 * | 7/2016 | ..... B08B 1/008 |
| WO | 8501971 | A1 | 5/1985 | |

* cited by examiner

*Primary Examiner* — Erin F Bergner
(74) *Attorney, Agent, or Firm* — James Creighton Wray

(57) ABSTRACT

Ladder cleaning device, particularly for use on ladders mounted on offshore installations, wherein the ladder cleaning device comprises: —means for guiding and moving the device along the ladder —means for detecting a ladder rung —means for cleaning at least the detected rung.

20 Claims, 4 Drawing Sheets

LADDER CLEANING DEVICE

FIELD OF THE INVENTION

The present invention relates to a ladder cleaning device, particularly for use on ladders on offshore installations.

BACKGROUND OF THE INVENTION

On a number of offshore installations ladders are mounted on an exterior surface in order to allow service and maintenance personnel access to the installation.

The installations will typically be wind turbine towers, meteorological measuring stations, oil drilling rigs or other offshore installations.

In this application the invention will be described with reference to a wind turbine tower, but it is clear that any ladder arranged in a similar situation and environment will be prone to the same exposure and suitable to be cleaned by the apparatus and method according to the present invention. Furthermore, the ladder cleaning device according to the present invention will be suitable for cleaning ladders on various types of offshore installations.

Typically, when service is required, for example on a wind turbine, the service or maintenance personnel are sailed from shore to the wind turbine in need of maintenance. Before the personnel can leave the ship and proceed up into the wind turbine it is necessary to clean the access ladders. These ladders and particularly in the wet zone or splash zone will be covered by a slippery biofilm and furthermore various crustaceans may have attached themselves of the surfaces of the ladder. This fouling represents a danger/hazard to the personnel and needs to be cleaned prior to ascending the tower.

In order to minimize the risk for the personnel the ladders are routinely cleaned prior to the personnel scaling the ladder. Cleaning is typically carried out by hand-operated high-pressure jets from the deck of the ship such that the ship operator is forced to position the ship in close proximity or against the ladder and at the same time personnel need to operate the high-pressure cleaning device, typically from the deck of the ship.

This may be particularly difficult and dangerous, especially since the sea swells and/or waves may, even on a calm day lift and lower the boat many meters relative to the stationary offshore installation, and naturally under the harsher conditions the weather will have much greater impact and thereby make it much more difficult for the operator of the ship as well as the person cleaning the ladder to carry out the job in a safe manner without a high risk to personnel or damage to the installation.

Often when the weather is relatively bad the cleaning process may take a substantial amount of time. During that time the ship is idle and the personnel brought to the site for service and maintenance are also in a waiting position. These factors together create an unproductive extra cost which only serve to increase the overall cost of maintenance and operation of for example offshore wind turbines.

In addition, the weather conditions may sometimes render it impossible to safely clean the ladders by prior art methods, and therefore also safely allow access to the offshore installation by the service and maintenance personnel. In those instances it is clear that the entire trip has been a waste as none of the objects of the trip by the sea crew and maintenance/service personnel were obtained.

OBJECT OF THE INVENTION

Consequently, it is the object of the present invention to address these harsh circumstances and provide for a substantially continuously clean ladder being available when service and maintenance personnel are brought to the site.

DESCRIPTION OF THE INVENTION

The present invention addresses this by providing a ladder cleaning device, particularly for use on ladders mounted on offshore installations, wherein the ladder cleaning device comprises:

Means for guiding and moving the device along the ladder

Means for detecting a ladder rung

Means for cleaning at least the detected rung

The ladder cleaning device is autonomous which means that it will be able to move up and down along the ladder in order to bring the cleaning means into a position where the cleaning means may clean one or more rungs on the ladder.

Within the context of the present invention the term "substantially continuously clean ladder" shall be understood as by utilising the present invention it is possible to always keep the ladder clean from the bio-film, crustaceans and other detrimental pollutants, which has a tendency to aggregate on the ladders in the wet-zone. It is not necessarily to be understood as the apparatus is continuously in action. Bio-film and crustaceans build up over time, and it will therefore only be necessary to operate the apparatus at intervals, entirely depending on the ambient environment.

In order to ensure that the correct position of the device is obtained, the ladder cleaning device is equipped with a sensor means. The sensor means may be a physical device such as for example a flexible member that is brought into a position where it will engage the rungs as the cleaning device travels along the ladder. When a rung is detected for example by deflexion of the flexible member, a micro switch or the like is activated for stopping the cleaning device at that position, such that the cleaning means may be activated and the rung cleaned. The sensor means may also be optical members in any form and shape such that as a predefined pattern is recognized the sensor will provide input to a controlling unit which will stop the cleaning device in the correct position. In embodiments where optical means in the shape of video means are used, it is furthermore possible to program the video feed controller such that if no fouling of the rung is detected, the cleaning device may move on to another rung. This will naturally shorten the time necessary for cleaning the ladder and will avoid unnecessary cleaning.

In a further advantageous embodiment of the invention the ladder cleaning device is provided with means for cleaning a rung comprising a housing where in the housing is arranged a plurality of nozzles, such that as the housing is positioned close to the rung, the nozzles will issue a liquid directed at the rung. Consequently, by positioning the housing in the vicinity of the rung such that the nozzles are directed at the rung, it is possible to provide liquid under high pressure to the housing which will then be distributed through the housing or by other means, such that the liquid issues through the nozzles towards the rung and thereby washes off the fouling (bio-film, crustaceans etc.).

In general, with the present invention any type of nozzle is suitable as long as the water pressure achieves the object, i.e. to remove the fouling from the rungs. Especially preferred are the so-called turbo nozzles which rotate and thereby in addition to the action from the high pressure liquid, typically water, also will move the water jet in a certain pattern such that the fouling is worked from different sides in order to remove it from the surface of the rung. In certain environments, however, it is advantageous to use stationary nozzles in that ice and pollutants in the water, which is typically used as the cleaning liquid, may be detrimental to nozzles having movable parts and as such stationary simple nozzles will provide for more reliable cleaning action.

With the present invention being used on off-shore installations, the medium to be issued from the nozzles will typically be sea water (fresh water if the ladder to be cleaned is installed in fresh water). In the art pumps capable of providing enough pressure and water volume exist, such that effective water jets may issue from the nozzles. The high pressure pumps will easily be able to provide high pressure water to the nozzles at pressures of 100 bars, 200 bars or even higher. Likewise it is contemplated to use commercially available hydraulic motors and actuators in order to propel and manipulate the apparatus in order to avoid electrical and electronic equipment in the very harsh environments to which apparatuses of this type are exposed. Naturally it is possible to utilise electrical and electronic equipment. Usually, however, in order to obtain the reliability in these environments the costs are often relatively high.

It is therefore envisaged that the skilled person will, according to circumstances provide pump and activation means suitable for the task at hand.

In a still further advantageous embodiment of the invention the housing has an inner and outer surface where the inner surface has a general U-, inverted U or C-cross-sectional shape, such that the housing in use can be positioned such that the inner surface at least partly encases the rung, and where the nozzles are arranged on the inner surface, such that the nozzles in use issue liquid directed towards the rung.

With this configuration of the housing it is possible to arrange the housing and thereby the nozzles substantially surrounding the rung whereby the rung is almost enclosed by the housing. This in fact creates a very efficient washing zone surrounding the rung such that all surfaces of the rung are effectively cleaned with the same effect. Due to the environment in which the ladders are placed, i.e. off-shore in a harsh environment, heavy winds, rain and wave action, might influence the cleaning action, but by creating a cleaning zone by use of the embodiment of the invention described above, it is possible under all circumstance to achieve a reliable cleaning process.

In a still further advantageous embodiment the housing extends along the rung such that the housing covers 75 to 95% of the rung in that direction. Naturally it would be advantageous to clean 100% of the rung, but due to the environment in which the cleaning device is to operate it would be difficult to position the housing if the housing had an extent exactly corresponding to the entire rung. Therefore, by allowing the housing a smaller extent and thereby creating a smaller cleaning zone, it is achieved that the housing may be positioned substantially encasing a large portion of the rung quickly and with a high safety margin.

In a still further advantageous embodiment of the invention, the housing is in two sections: a first and a second section, connected by a pivot mechanism, such that the two sections in an open position may be guided over the rung and closed in this position thereby substantially surrounding the cross-section of the rung. By dividing the housing in two sections typically in an upper and a lower section, it is possible, in the open position to place the cleaning means with respect to the rung, much easier and with less tolerance, had the housing not been able to open i.e. pivot the sections relative to each other.

Once the sections are positioned correctly relative to the housing, the sections may be manipulated such that they close around the rung, creating a cleaning zone substantially surrounding the entire rung. The opening and closing of the housing sections may be provided with a suitable mechanism driven by water pressure in that water pressure must be provided in order to carry out the cleaning process and as such is available on site and therefore no extra or special provisions need to be made in order to control the movements of the two sections. The two sections may also be moved by mechanical means such that as the entire cleaning device moves along the ladder a suitable gear mechanism may be activated in order to open the sections and likewise for example activated by the sensor means, the same gear mechanism may be used to close the two sections surrounding the rung. Naturally the pivotable movement of the two sections may also be achieved by electrical means, but this requires that also an electrical installation be provided in connection with the ladder cleaning device.

In at still further advantageous embodiment of the invention a clamping device for clamping the cleaning device in a fixed position relative to a rung is provided, where the clamping device may have a brake mechanism engaging the ladder or the clamping device engages and releasably fixates the moving means of the cleaning device. This embodiment is particularly interesting in that in this manner it is possible to fixate the cleaning device relative to the ladder and thereby create a stable environment in which the cleaning device may carry out the cleaning processes relating to the cleaning of the rung. It is particularly useful in the harsh environment present in offshore environments such that if cleaning is to be carried out in the wave active zone, the cleaning device may be able to resist the impact of waves due to the fact that it is clamped to the ladder. The same is naturally true in any wind conditions which by means of the clamping device will not influence the cleaning of the rungs or the travel of the ladder cleaning device.

In a still further advantageous embodiment of the invention the cleaning device comprises a first axle which first axle in use is arranged parallel to the longitudinal direction of the rung to be cleaned, and substantially extends along the rung, and where one or more nozzles are arranged to travel along said first axle, where the nozzles are directed towards the rung, and a second axle arranged substantially orthogonal to said first axle, where said first axle can move along said second axle.

In this embodiment no housing is provided, but rather an axle which axle is arranged such that it extends along the rung. By having one or more nozzles travelling along the axle such that the nozzles are directed towards the rung it is possible to create a cleaning action along the rungs by moving the nozzles along the axles as the nozzles issues high pressure liquid towards the rung. The second axles arranged substantially orthogonal to the first axle ensures that the first axle by its movement along the second axle can be brought into close proximity to the rung and be brought away from the rung as the cleaning device travels along the ladder.

In a further embodiment of the invention the second axle can pivot around a pivot point arranged in proximity to said clamping device. This embodiment provides a determined movement form the second axle and thereby also for the first axle such that it is possible to move the first axle into and out of close proximity to the rung bringing the nozzles into a cleaning position or out of a cleaning position simply by pivoting the second axle.

In a still further advantageous embodiment of the invention the means for guiding the cleaning device along a ladder comprises one or more rails fastened to the ladder, and where the cleaning device comprises rollers for rolling along the one or more rails.

These rails may double as the ladder rises, i.e. the members to which the rungs are fastened, or may be separate rails fastened on an already existing ladder. The rails may naturally be fastened on the front, on the side or on the rear side of the ladder depending on the construction of the ladder and the cleaning device roller arrangement. If only a single rail is used, it is necessary to provide a relatively stiff roller construction, i.e. the construction travelling up and down said rail, but traditionally two rails will be provided one on each side of the rung such that a very stable roller arrangement and thereby travel along the ladder may be provided.

In a still further advantageous embodiment the device further comprises means for propelling said cleaning device along the rails, and where the means for propelling the cleaning device is a motor propelling the device by a rotatable member engaging the rungs of the ladder.

In this embodiment the cleaning device engages the rungs of the ladder themselves such that the cleaning devices climb the ladder step by step/rung by rung. This provides the advantage that it is always easily identifiable where the rung to be cleaned is relative to the means for propelling the cleaning device and as such the cleaning routines may be carried out on each rung very reliably as the cleaning device is in contact with each rung. The motor may be hydraulically driven, for example by water pressure.

In a further advantageous embodiment of the invention the cleaning device is suspended in one or more wires or chains, from one or more winches, said winches arranged above the uppermost rung of the ladder. This has the advantage that the cleaning device may be a lighter construction in that the means for moving the cleaning device along the ladder are arranged as winches above the uppermost rung of the ladder and are not part of the cleaning device as such.

Both wires and chains are substantially non-extendable such that by measuring the advance of the cleaning device by measuring input from the winches it is possible to determine very accurately the exact position of the cleaning device relative to the rungs from predefined parameters.

DESCRIPTION OF THE DRAWING

The invention will now be described with reference to the accompanying drawing wherein.

DETAILED DESCRIPTION OF THE INVENTION

Figure 1:
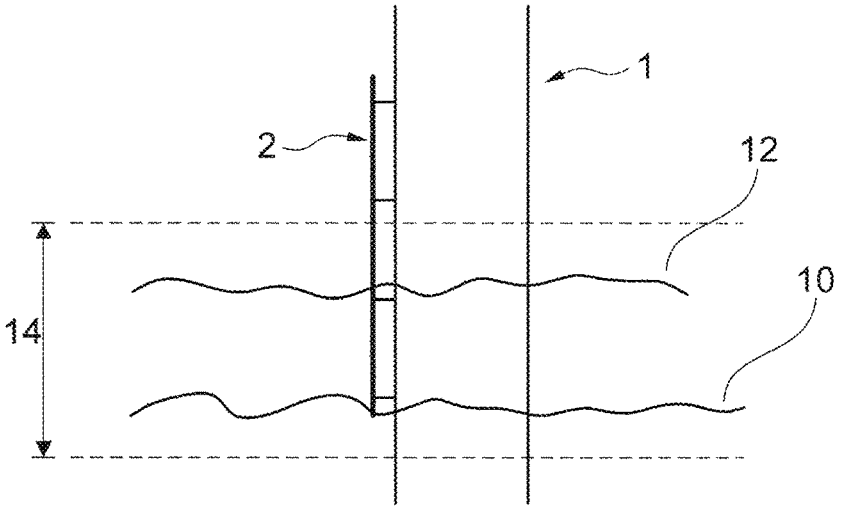
FIG. 1 illustrates schematically an offshore construction.

In FIG. 1 is schematically illustrated an offshore construction 1 positioned at a location where the water level may vary between a low tide indicated by the wavy line 10 and a high tide indicated by the wavy line 12. Due to fluctuations in the water level, for example caused by wind, storms etc., the zone which is exposed to the marine environment and therefore may be fouled by biofilms, crustaceans etc. is indicated by 14.

A ladder 2 for allowing access to the offshore installation positioned with a part of the ladder in this zone 14 will accumulate fouling on the rungs of the ladder, at least in the zone 14. It is therefore necessary to regularly clean the ladder 2 in order to minimize the risk for personnel needing to ascend the ladder in order to gain access to the offshore installation 1. The offshore installation 1 may be a wind turbine tower, a leg of a drilling rig, weather station or the like.

Figure 2:
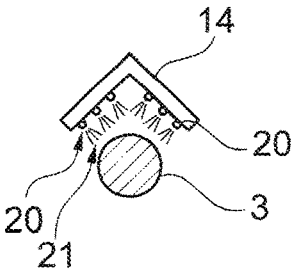
FIG. 2 illustrates a cross-section through a rung of the ladder
Figure 7:
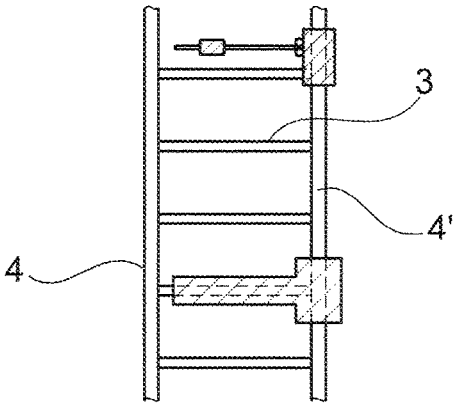
FIG. 7 illustrates a ladder.

In FIG. 2 is illustrated a cross-section through a rung 3 of the ladder 2. On the rung may be marine fouling which needs to be removed. For this purpose the invention provides a ladder cleaning device where the means for cleaning in this embodiment is a housing 14 having an extent in the longitudinal direction of the rung 3, i.e. an extent between the risers 4, 4' of a ladder as indicated in FIG. 7.

Turning back to FIG. 2 the housing 14 is provided with nozzles 20 from which nozzles 20 high pressure jets of liquid, typically water 21, is directed towards the rung 3 to be cleaned. In this embodiment the rung 3 has a substantially circular cross section whereas the rung 3' illustrated in FIG. 3 has a square cross-section. The rung 3' having a square cross-section oriented as indicated in FIG. 3 will provide a sharp edge or apex 5 for the personnel to climb the ladder on.

This has the advantage that it is relatively easier to clean a sharp edge and thereby make the footing of the personnel more secure on the ladder's rung than what is normally possible with the rungs 3 having a circular cross-section.

Figure 3:
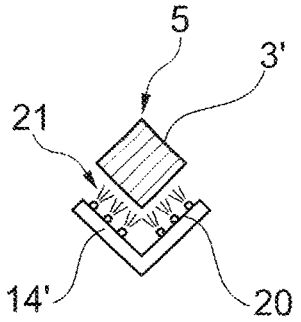
FIG. 3 illustrates the housing of the cleaning device

In FIG. 3 the housing of the cleaning device 14 is arranged for spraying the underside of the rung 3' and it is foreseen that the means for cleaning the rungs shall be positioned in both positions, i.e. the positions illustrated in FIG. 2 and FIG. 3 in order to clean the entire surface of the rung. This may either be achieved by positioning the means for cleaning the rung 14 in the position indicated by FIG. 2 and thereafter turning the means for cleaning 14 around such that they are arranged in the position as indicated in FIG. 3.

Figure 8:
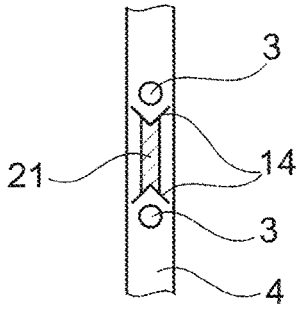
FIG. 8 illustrates means for cleaning comprising a body having an arrangement of two housings.

Alternatively, as illustrated in FIG. 8 the means for cleaning 21 may comprise a body having an arrangement of two housings 14 turned in opposite directions such that the upper cleaning device 14 will be able to clean the underside of a rung 3 and at the same time in the lower portion a further cleaning device 14 will be able to clean the upper surface of an adjacent rung 3 as illustrated.

Between the rung 3, 3' and the housing 14, 14' is created a cleaning zone illustrated by the jets 21 issuing from the nozzles 20 of the cleaning device housing 14, 14'. Due to the protection created by the housing 14, 14' the cleaning zone will be at least partly screened from the ambient environment and therefore any detrimental effect, wave action and wind would have on the cleaning process is at least to a certain degree due to the establishment of the cleaning zone 21.

Figure 4:
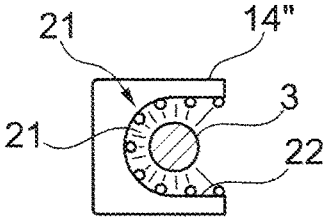
FIGS. 4 and 5 illustrate cross-sections of various housings
Figure 5:
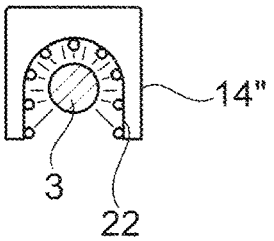

Turning to FIGS. 4 and 5 the housing 14" is provided with a cross-section where an inner surface 22 of the housing 14, 14" has a cross-sectional shape in the shape of a C or U or inverted U. In this manner it is possible to position the housing 14" such that it substantially encloses the rung 3 and in this manner establishes a cleaning zone 21 substantially surrounding the entire rung such that cleaning of the rung, both the upper and the lower surfaces, may be carried out in one action. Naturally nozzles 21 will be arranged and distributed strategically on the inner surface 22 of the housing 14" such that liquid may issue directed towards the rung cleaning all surfaces of the rung 3.

Figure 6:
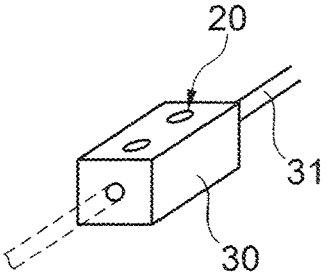
FIG. 6 illustrates schematically an alternative embodiment of the invention.

In FIG. 6 is schematically illustrated an alternative embodiment of the invention where the nozzles 20 are arranged in a housing 30. The housing 30 may move along an axle 31 where the axle 31 in use will be positioned adjacent a rung 3 such that the liquid issuing from the nozzles 20 will be directed at the rung. By manipulating the movement of the housing 30 and the position of the axle 31 relative to the rungs of the ladder it will be possible to clean the rungs of the ladder.

Figure 9:
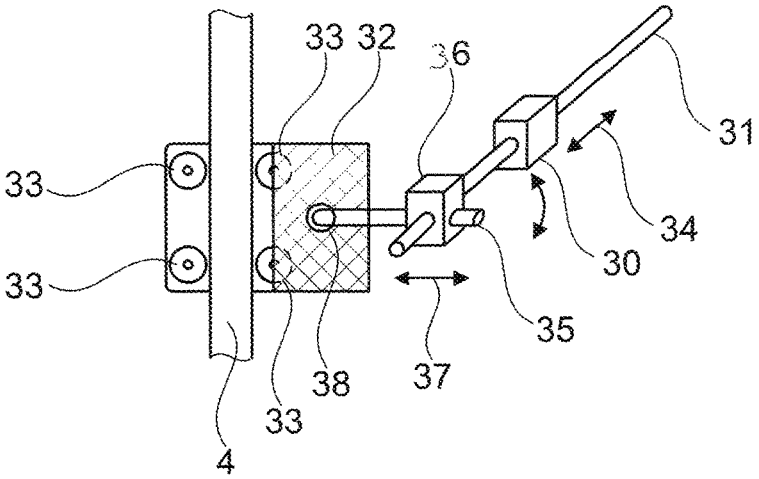
FIG. 9 illustrates the construction of a device where it will be possible to manipulate the housing 30 into the desirable cleaning position.

In FIG. 9 is illustrated the construction of such a device where it will be possible to manipulate the housing 30 into the desirable cleaning position. The device according to the embodiment illustrated in FIG. 9 comprises means 32 for travelling along the riser 4 of the ladder. In this embodiment the means 32 is in the shape of a carriage comprising rollers 33 which engage the riser 4 in order to guide and allow travel along the ladder.

Naturally, the carriage 32 comprising the rollers 33 may be arranged for travel on a separate rail or two carriages may be provided on either side of the ladder 2 in order to guide the movement of the cleaning device 30. The cleaning device 30 is arranged on an axle 31 such that the cleaning device 30 may travel along the length of the axle 31 as indicated by the arrow 34.

The axle 31 is arranged on a second axle 35 such that the interface unit 36 connecting the first axle 31 to the second axle 35 is able to travel in the longitudinal direction of the axle 35 as indicated by the arrow 37. The second axle 35 is pivotally mounted in a pivot point 38 on the housing 32 such that the entire cleaning arrangement, i.e. the cleaning device 30, the first axle 31 and the second axle 35 may pivot relative to the casing 32 and thereby relative to the riser 4 of the ladder making it possible to swing the cleaning device 30 into and out of a proximate position to a rung on a ladder 2.

For the sake of clarity, various pressure hoses and other installations such as sensors etc. are not illustrated in FIG. 9.

Figure 10:
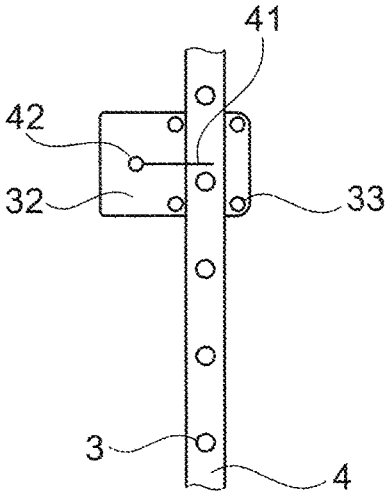
FIG. 10 illustrates the casing 32.

In order to detect the presence of a rung the casing 32 as illustrated with reference to FIG. 10 may be provided with sensor means. FIG. 10 illustrates a cross-section through a ladder 2 provided with risers and rungs and a casing for example similar to the casing described above with reference to FIG. 9 provided with rollers 33 such that the casing 32 may travel along the riser 4 of the ladder. In this embodiment the means for sensing the presence of a rung 3 is a flexible member 41 which flexible member 41 is arranged such that it will engage a rung as the casing 32 travels up and down the riser 4 of the ladder. As the flexible member 41 engages a rung it will flex and thereby rotate around its pivot point 42 where means for example in the shape of a micro-switch are provided in order to detect the movement of the flexible member 41 and thereby halt the travel of the carriage 32 in a determined position relative to a rung. In this position the cleaning means may be activated in order to clean the rung before the carriage travels on until the next rung.

Figure 11:
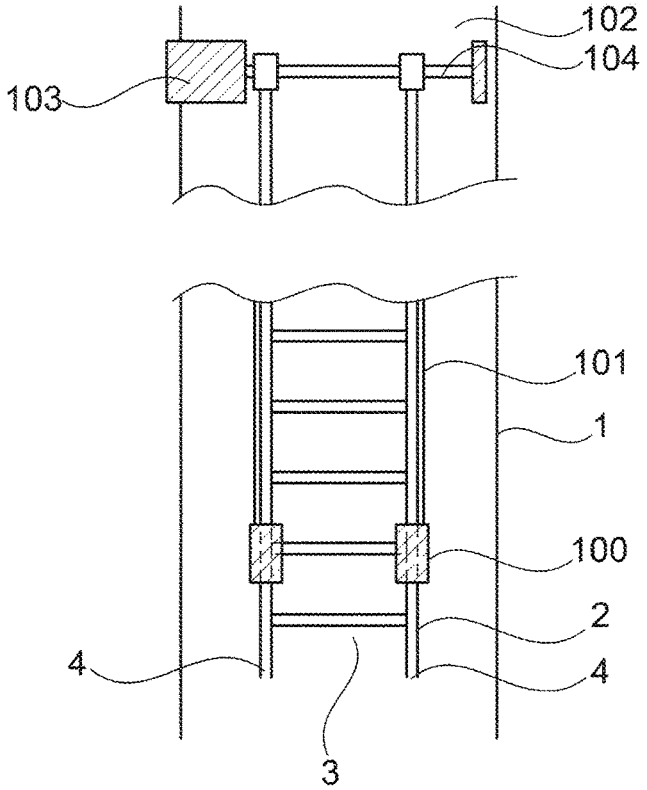
FIG. 11 illustrates one embodiment of how to propel the cleaning device along the ladder of an offshore installation

In FIG. 11 is illustrated one embodiment of how to propel the cleaning device along the ladder of an offshore installation. The offshore installation 1 is provided on the exterior surface with a ladder 2. The ladder 2 has risers and rungs 4, 3 and means for cleaning 100 generally indicated by the boxes 100. The means for cleaning 100 are by means of wires or chains 101 connected to a winch device 102 arranged above the ladder 2. The winch device in this embodiment comprises a motor 103 driving an axle 104 such that the chains or wires may be wound on the axle in order to position the cleaning device 100 in the correct position relative to the rungs 3 of the ladder 2.

Figure 12:
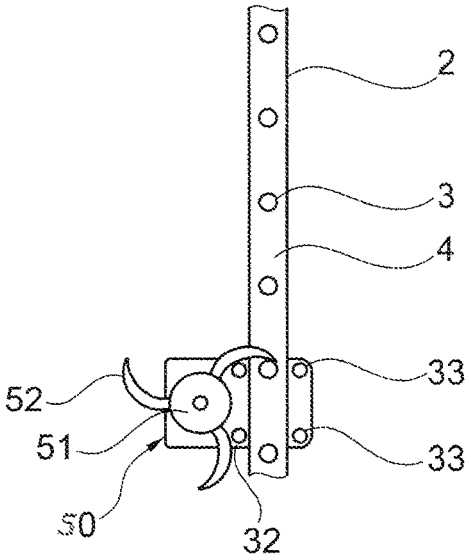
FIG. 12 illustrates an alternative embodiment to provide the propulsion along the ladder.

In FIG. 12 is illustrated an alternative embodiment to provide the propulsion along the ladder 2. In this embodiment the carriage 32 is provided with a crawler mechanism. The crawler mechanism has engagement arms 52 connected to an axle 51 such that as the axle is rotated the crawler arms 52 will move in a circular fashion. The crawler arms 52 are designed with a curvature such that they will engage a rung and as rotation of the axle 51 is continued, the crawler device will propel itself upwards such that the following crawler arm 52 will be able to engage the rung immediately above the rung which is already in engagement with the crawler arm of the device and in this manner the device will be able to crawl its way upwards along the ladder 2.

The casing 32 is again provided with rollers 33 in order to guide the casing's travel and thereby also the cleaning means' position relative to the rungs.

Figure 13:
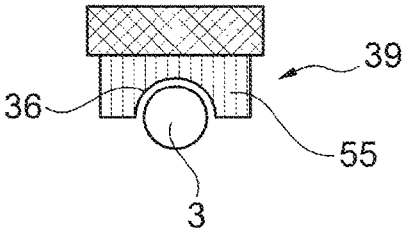
FIG. 13 illustrates an embodiment where the first axle 31 may additionally be provided with a scraper 39.

Turning back to the embodiment described above with reference to FIG. 9 the first axle 31 may additionally be provided with a scraper 39, see FIG. 13, also provided for movement along the first axle 31 such that as the device is brought into a cleaning position the scraper will move back and forth along the rung in order to scrape off any fouling. The scraper itself may be devised in such a manner that depending on the cross-sectional shape of the rung scraping may be sufficient in order to clean the rung, but otherwise a combination of both the scraper and the water jets may be provided. The scraper 39 will typically be provided with a scraping member 55 being relatively stiff, but still resilient and provided with a cross-sectional opening 56 corresponding to the cross-section of the rung to be cleaned. In this manner a tight fit around the rung may be provided such that efficient scraping in facilitated.

Turning shortly back to FIG. 7 the device illustrated at the lower part of the ladder 2 substantially corresponds to the device described with respect to FIGS. 2, 3, 4 and 5 whereas the device illustrated in the upper part of the ladder corresponds to the device described with reference to FIGS. 6 and 9.

Figure 14A:
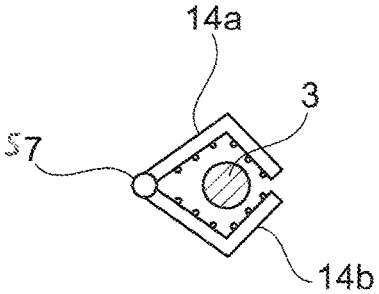
FIGS. 14*a* and 14*b* illustrate further embodiments of the cleaning device.
Figure 14B:
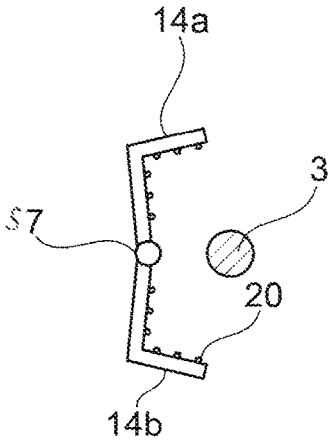

In FIGS. 14A and 14B is illustrated a further embodiment of the cleaning device where the cleaning device is provided with a pivot point 57 such that the housing is in two sections 14A and 14B. Due to the provision of the pivot point the cleaning device may be opened as illustrated in FIG. 14B such that it is easy to arrange the cleaning device around a rung 3 and by pivoting the two halves of the housing 14A, 14B around the pivot point, it is possible to substantially entirely enclose the rung thereby creating a substantially closed cleaning zone ensuring a thorough cleaning of the rung.

At the same time, by enclosing the rung 3 by the two sections 14A, 14B influence from the ambient environment is minimized such that waves, spray, wind and the like do not influence the cleaning process which therefore is not influenced by the surroundings.

Figure 15:
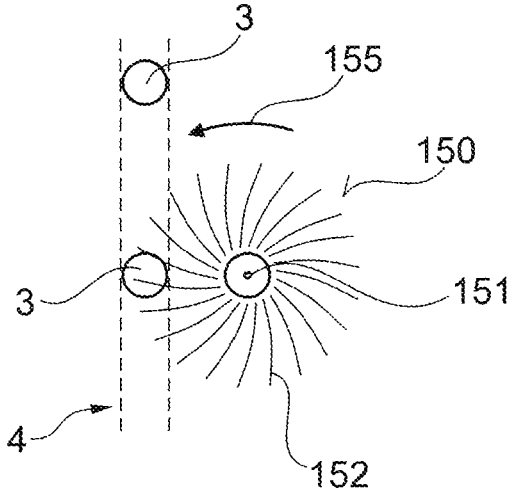
FIG. 15 illustrates an embodiment where a brush 150 mounted on an axle 151 rotates.

In FIG. 15 is illustrated an embodiment where a brush 150 mounted on an axle 151 rotates whereby the bristles of the brush engages a rung 3 on a ladder. The risers 4 of the ladder are indicated by dashed lines.

Naturally the brushes may rotate in either direction such that for example when the ladder cleaning device according to the invention is travelling downwards relative to the ladder the brushes rotate in the direction indicated by the arrow 155, and when the ladder cleaning device according to the invention is travelling upwards, the brushes are rotated in an opposite direction such that the bristles 152 of the brushes 150 will be able to effective engage and clean the available surfaces of the rungs 3.

Figure 16:
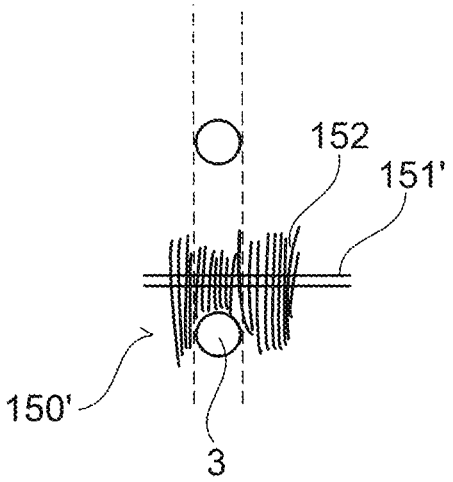
FIG. 16 illustrates an embodiment where the bristles 152' are arranged on a brush 150' such that they rotate about an axle

In the embodiment illustrated in FIG. 16 the bristles 152' are arranged on a brush 150' such that they rotate about an axle 151' which is substantially perpendicular to the rung 3. In this embodiment it is foreseen that the axle 151' shall move back and forth along the rung in order to clean the entire width of the rung 3.

In the embodiments above it is foreseen that the device will be provided with pump means drawing water from the surrounding sea. Alternatively, alternative water supply may be provided. Where the sea is the source of water, the water supply shall be designed to be able to reach the water's surface regardless of the tide.

Above, the invention has been described with reference to various embodiments of the invention, but it is clear that the invention should not be limited to these embodiments but shall be limited to the scope of the appended claims.

The invention is characterised for example by the following aspects:

A. Ladder cleaning device, particularly for use on ladders mounted on offshore installations, wherein the ladder cleaning device comprises:
   - means for guiding and moving the device along the ladder
   - means for detecting a ladder rung
   - means for cleaning at least the detected rung B. Ladder cleaning device where the means for cleaning a rung comprises a housing where in the housing is arranged a plurality of nozzles, such that as the housing is positioned close to the rung, the nozzles will issue a liquid directed at the rung.

C. Ladder cleaning device where the housing has an inner and outer surface, and where the inner surface has a general U-, inverted U or C-cross-sectional shape, such that the housing can be positioned such that the inner surface at least partly encases the rung, and where the nozzles are arranged on the inner surface, such that the nozzles in use issue liquid directed towards the rung.

D. Ladder cleaning device where the housing extends along the rung such that the housing covers between 75 to 95% of the rung in that direction.

E. Ladder cleaning device where the housing is in two sections: a first and a second section, connected by a pivot mechanism, such that the two sections in an open position may be guided over the rung and closed in this position thereby substantially surrounding the cross-section of the rung.

F. Ladder cleaning device wherein a clamping device for clamping the cleaning device in a fixed position relative to a rung is provided, where the clamping device may have a brake mechanism engaging the ladder or the clamping device engages and releasably fixates the cleaning device' moving means.

G. Ladder cleaning device where said cleaning device comprises a first axle which first axle in use is arranged parallel to the longitudinal direction of the rung to be cleaned, and substantially extends along the rung, and where one or more nozzles are arranged to travel along said first axle, where the nozzles are directed towards the rung, and a second axle arranged substantially orthogonal to said first axle, where said first axle can move along said second axle.

H. Ladder cleaning device where the second axle can pivot around a pivot point arranged in proximity to said clamping device.

I. Ladder cleaning device where the means for guiding the cleaning device along a ladder comprises one or more rails fastened to the ladder, and where the cleaning device comprises rollers for rolling along the one or more rails.

J. Ladder cleaning device where the device further comprises means for propelling said cleaning device along the rails, and where the means for propelling the cleaning device is a motor propelling the device by a rotatable member engaging the rungs of the ladder.

K. Ladder cleaning device where the cleaning device is suspended in one or more wires or chains, from one or more winches, said winches arranged above the uppermost rung of the ladder.

L. Ladder cleaning device where the means for detecting a rung is either:
   a. A mechanical flexible member extending from the cleaning device past a plane of the ladder in which plane the rungs and stringers of the ladder are positioned, where the flexible member is connected to a switch, such that as the mechanical member is deflected the switch is activated providing input to a control unit controlling the travel of the cleaning device, or
   b. Optical means preprogrammed to recognize a rung, where upon recognition of a rung this recognition provides input to a control unit controlling the travel of the cleaning device, or
   c. A tachymeter measuring the traveled distance since last encounter with a rung, the measurement providing input to a control unit controlling the travel of the cleaning device, or
   d. A laser measuring device, measuring the distance travel between a fixpoint on the ladder or cleaning device and the cleaning device or a fixpoint on the ladder, which distance is providing input to a control unit controlling the travel of the cleaning device.

M. Ladder cleaning device wherein the cleaning is performed by high-pressure liquid issuing from nozzles, where the liquid is water.

N. Ladder cleaning device, wherein a scraping tool is provided, said scraping tool mounted on an extendable arm on the cleaning device, whereby when the cleaning device is in a cleaning position, the scraping tool will engage and be moved along desired surfaces of the rung.

O. Method of cleaning the rungs of a ladder in an off-shore environment, particularly in the splash-zone and/or the tidal variation zone, where a ladder cleaning device is used, wherein:

a) the device is activated to move from a storage position above the splash-zone and/or the tidal variation zone, along the ladder to be cleaned until a specified rung is encountered;

b) the housing of the cleaning device is moved from a travelling position into a position relative to the rung to be cleaned such that the nozzles may spray the rungs surfaces;

c) Liquid pump means are activated in order to force liquid out of the nozzles towards the rung to be cleaned, where after a pre-determined cleaning cycle, the pump means are switch-off;

d) the housing of the cleaning device is retracted back to the travelling position, e) the cleaning device is moved further along the ladder to be cleaned until a further specified rung is encountered;

f) steps b) through e) is repeated as many times as desired/necessary g) the cleaning device is after the last rung to be cleaned is processed moved back into the cleaning device's storage position.

P. Method wherein activation of the device is either initiated from a remote control unit, or by means of a built in timer initiating cleaning at regular preprogrammed intervals, or is initiated manually by operating a control panel connected to the device.

The invention claimed is:

1. Ladder cleaning device, particularly for use on ladders mounted on offshore installations, where said ladder is made up from two parallel risers connected by rungs, wherein the ladder cleaning device comprises:

means for guiding and moving the device along the ladder, where said means for guiding and moving is selected among winches, rollers, or a crawler mechanism where the means for guiding the cleaning device along said ladder comprises one or more rails fastened to the ladder, and where the cleaning device comprises rollers for rolling along the one or more rails, means for detecting a ladder rung where the means for detecting a rung is either:

a. A mechanical flexible member extending from the cleaning device past a plane of the ladder in which plane the rungs and risers of the ladder are positioned, where the flexible member is connected to a switch, such that as the mechanical member is deflected the switch is activated providing input to a control unit controlling the travel of the cleaning device, or b. Optical means preprogrammed to recognize a rung, where upon recognition of a rung this recognition provides input to a control unit controlling the travel of the cleaning device, or c. A tachymeter measuring the traveled distance since last encounter with a rung, the measurement providing input to a control unit controlling the travel of the cleaning device, or d. A laser measuring device, measuring the distance travel between a fixpoint on the ladder and the cleaning device, which distance is providing input to a control unit controlling the travel of the cleaning device;

means for cleaning at least the detected rung where the means for cleaning a rung comprises either:

a housing where in the housing is arranged a plurality of nozzles, such that as the housing is positioned close to the rung, the nozzles will issue a liquid directed at the rung or;

a scraping tool is provided, said scraping tool mounted on an extendable arm on the cleaning device, whereby when the cleaning device is in a cleaning position, the scraping tool will engage and be moved along desired surfaces of the rung;

or one or more brushes arranged for rotation relative to the device, such that bristles of the brushes engage the rungs of the ladder.

2. Ladder cleaning device according to claim 1 where the means for cleaning a rung comprises a housing where in the housing is arranged a plurality of nozzles, such that as the housing is positioned close to the rung, the nozzles will issue a liquid directed at the rung.

3. Ladder cleaning device according to claim 2 where the housing has an inner and outer surface, and where the inner surface has a general U-, inverted U or C-cross-sectional shape, such that the housing can be positioned such that the inner surface at least partly encases the rung, and where the nozzles are arranged on the inner surface, such that the nozzles in use issue liquid directed towards the rung.

4. Ladder cleaning device according to claim 2, where the housing is in two sections: a first and a second section, connected by a pivot mechanism, such that the two sections in an open position may be guided over the rung and closed in this position thereby substantially surrounding the cross-section of the rung.

5. Ladder cleaning device according to claim 1 wherein a clamping device for clamping the cleaning device in a fixed position relative to a rung is provided, where the clamping device may have a brake mechanism engaging the ladder or the clamping device engages and releasably fixates the cleaning device' moving means.

6. Ladder cleaning device according to claim 5, where said cleaning device comprises a first axle which first axle in use is arranged parallel to the longitudinal direction of the rung to be cleaned, and substantially extends along the rung, and where one or more nozzles are arranged to travel along said first axle, where the nozzles are directed towards the rung, and a second axle arranged substantially orthogonal to said first axle, where said first axle can move along said second axle.

7. Ladder cleaning device according to claim 6, where the second axle can pivot around a pivot point arranged in proximity to said clamping device.

8. Ladder cleaning device according to claim 1, where the means for guiding the cleaning device along a ladder comprises one or more rails fastened to the ladder, and where the cleaning device comprises rollers for rolling along the one or more rails.

9. Ladder cleaning device according to claim 8, where the device further comprises means for propelling said cleaning device along the rails, and where the means for propelling the cleaning device is a motor propelling the device by a rotatable member engaging the rungs of the ladder.

10. Ladder cleaning device according to claim 8, where the cleaning device is suspended in one or more wires or chains, from one or more winches, said winches arranged above the uppermost rung of the ladder.

11. Ladder cleaning device according to claim 1, wherein the means for cleaning is in the form of a scraping tool, said scraping tool mounted on an extendable arm on the cleaning device, whereby when the cleaning device is in a cleaning position, the scraping tool will engage and be moved along desired surfaces of the rung.

12. Ladder cleaning device according to claim 1 wherein the means for cleaning is in the form of one or more brushes, which brushes are arranged for rotation relative to the device, such that bristles of the brushes engage the rungs of the ladder.

13. Ladder cleaning device according to claim 12 wherein the brushes rotates around axles, which axles in use are arranged parallel to the rungs of the ladder.

14. Ladder cleaning device according to claim 12, wherein the brushes rotates around axles, which axles in use are arranged at an oblique angle relative to the rungs of the ladder.

15. Method of cleaning the rungs of a ladder in an off-shore environment, particularly in the splash-zone and/or the tidal variation zone, where a ladder cleaning device according to claim 1 is used, wherein:

a) the device is activated to move from a storage position above the splash-zone and/or the tidal variation zone, along the ladder to be cleaned until a specified rung is encountered;

b) where the means for cleaning a rung comprises the housing, where the housing of the cleaning device is moved from a travelling position into a position relative to the rung to be cleaned such that the plurality of nozzles arranged in the housing may spray the rungs surfaces;

c) Liquid pump means are activated in order to force liquid out of the nozzles towards the rung to be cleaned, where after a pre-determined cleaning cycle, the pump means are switch-off;

d) the housing of the cleaning device is retracted back to the travelling position, e) the cleaning device is moved further along the ladder to be cleaned until a further specified rung is encountered;

f) steps b) through e) are repeated as many times as desired/necessary g) after the last rung to be cleaned is processed, the cleaning device is moved back into the cleaning device's storage position.

16. Ladder cleaning device, particularly for use on ladders mounted on offshore installations, where said ladder is made up from two parallel risers connected by rungs, wherein the ladder cleaning device comprises:

a carriage for traveling along at least one of the risers means for guiding and moving the device along the ladder, where said means for guiding and moving is selected among winches, rollers, or a crawler mechanism where the means for guiding the cleaning device along said ladder comprises one or more rails fastened to the ladder, and where the cleaning device comprises rollers for rolling along the one or more rails, means for detecting a ladder rung where the means for detecting a rung is either:

a. A mechanical flexible member extending from the cleaning device past a plane of the ladder in which plane the rungs and stringers of the ladder are positioned, where the flexible member is connected to a switch, such that as the mechanical member is deflected the switch is activated providing input to a control unit controlling the travel of the cleaning device, or b. Optical means preprogrammed to recognize a rung, where upon recognition of a rung this recognition provides input to a control unit controlling the travel of the cleaning device, or c. A tachymeter measuring the traveled distance since last encounter with a rung, the measurement providing input to a control unit controlling the travel of the cleaning device, or d. A laser measuring device, measuring the distance travel between a fixpoint on the ladder or cleaning device and the cleaning device or a fixpoint on the ladder, which distance is providing input to a control unit controlling the travel of the cleaning device;

means for cleaning at least the detected rung where the means for cleaning a rung comprises either:

a housing where in the housing is arranged a plurality of nozzles, such that as the housing is positioned close to the rung, the nozzles will issue a liquid directed at the rung or;

a scraping tool is provided, said scraping tool mounted on an extendable arm on the cleaning device, whereby when the cleaning device is in a cleaning position, the scraping tool will engage and be moved along desired surfaces of the rung;

or one or more brushes arranged for rotation relative to the device, such that bristles of the brushes engage the rungs of the ladder.

17. Ladder cleaning device according to claim 16, where the means for cleaning a rung comprises a housing, where in the housing is arranged a plurality of nozzles, such that as the housing is positioned close to the rung, the nozzles will issue a liquid directed at the rung, where the housing has an inner and outer surface, and where the inner surface has a general U-, inverted U or C-cross-sectional shape, such that the housing can be positioned such that the inner surface at least partly encases the rung, and where the nozzles are arranged on the inner surface, such that the nozzles in use issue liquid directed towards the rung, where the housing is in two sections: a first and a second section, connected by a pivot mechanism, such that the two sections in an open position may be guided over the rung and closed in this position thereby substantially surrounding the cross-section of the rung.

18. Ladder cleaning device according to claim 16, wherein a clamping device for clamping the cleaning device in a fixed position relative to a rung is provided, where the clamping device may have a brake mechanism engaging the ladder or the clamping device engages and releasably fixates the cleaning device' moving means, where said cleaning device comprises a first axle which first axle in use is arranged parallel to the longitudinal direction of the rung to be cleaned, and substantially extends along the rung, and where one or more nozzles are arranged to travel along said first axle, where the nozzles are directed towards the rung, and a second axle arranged substantially orthogonal to said first axle, where said first axle can move along said second axle, where the second axle can pivot around a pivot point arranged in proximity to said clamping device.

19. Ladder cleaning device according to claim 16, where the means for guiding the cleaning device along a ladder comprises one or more rails fastened to the ladder, and where the cleaning device comprises rollers for rolling along the one or more rails, where the device further comprises means for propelling said cleaning device along the rails, and where the means for propelling the cleaning device is a motor propelling the device by a rotatable member engaging the rungs of the ladder, where the cleaning device is suspended in one or more wires or chains, from one or more winches, said winches arranged above the uppermost rung of the ladder.

20. Ladder cleaning device according to claim 1, wherein the means for cleaning include one or more brushes are arranged for rotation relative to the device, such that bristles of the brushes engage the rungs of the ladder, wherein the brushes rotate around axles, which axles in use are arranged parallel to the rungs of the ladder, or which axles in use are arranged at an oblique angle relative to the rungs of the ladder.

* * * * *